United States Patent [19]

Affouard

[11] 4,117,768

[45] Oct. 3, 1978

[54] HYDRAULIC ROTARY DEVICES

[76] Inventor: Robert Affouard, 3, rue R. Lanen, 92190 Meudon, France

[21] Appl. No.: 675,266

[22] Filed: Apr. 9, 1976

[30] Foreign Application Priority Data

Apr. 16, 1975 [FR] France ..... 75 11869

[51] Int. Cl.[2] ..... F01B 13/04

[52] U.S. Cl. ..... 91/499

[58] Field of Search ..... 91/488, 499, 506, 507

[56] References Cited

U.S. PATENT DOCUMENTS

| | | | |
|---|---|---|---|
| 2,486,690 | 11/1949 | Tipton | 91/475 |
| 2,608,159 | 8/1952 | Born | 91/498 |
| 2,757,612 | 8/1956 | Shaw | 91/488 |
| 3,241,495 | 3/1966 | Diedrick et al. | 91/507 |
| 3,739,692 | 6/1973 | Bell | 91/506 |

*Primary Examiner*—William L. Freeh

*Attorney, Agent, or Firm*—Cushman, Darby & Cushman

[57] ABSTRACT

In a rotary device with a rotating cylinder barrel of the kind having a plurality of pistons partially engaged in cylinders formed in the cylinder barrel and the axes of which are spaced around the axis of the cylinder barrel, the pistons are displaced in their cylinders by an oblique plate against which there rest shoes carrying spherical heads which are engaged in spherical seatings terminating the pistons. Each piston is rigidly connected to a supporting element which transmits to a skirt, rigidly connected to the cylinder barrel, the radial component of the reaction exerted by the plate on the piston.

5 Claims, 6 Drawing Figures

HYDRAULIC ROTARY DEVICES

BACKGROUND OF THE INVENTION

1. Field of the Invention

This invention relates to rotary devices with a cylinder barrel which can serve as a pump or as a motor. More particularly, the invention relates to such devices of the type which comprises a stator enclosing a rotor with a cylinder barrel and an oblique plate which acts, by means of spherical head and seating assemblies, on the outer ends of a plurality of cylindrical pistons partially engaged in cylinders which are formed in the cylinder barrel and the geometrical axes of which are regularly distributed over a surface of revolution coaxial with said cylinder barrel, the portion of each piston which is adjacent to the corresponding spherical head and seating assembly being rigidly connected to a rigid supporting element which slides axially against the internal face of an external skirt, which skirt is rigidly connected to the cylinder barrel for rotation therewith and surrounds all those portions of all the pistons which are outside the cylinders. Said surface of revolution is generally cylindrical but may also be conical.

2. Description of Prior Art

A pump of this type is described in U.S. Pat. No. 1,427,740 (Robert H. Johnson). In that pump, the oblique plate is rotary and carries seatings for spherical heads integral with the pistons. On each piston, the rigid supporting element, the purpose of which is not specified, is spaced axially apart from the center of the spherical head and it has an arched shape which ensures that it has a purely radial contact with the external skirt.

SUMMARY OF THE INVENTION

The invention applies to devices of the type set forth wherein said oblique plate is stationary and has a plane surface on which there slide shoes articulated on the pistons through said spherical head and seating assemblies and its object is to adapt these devices in such a manner that the reaction exerted by the oblique plate on the end of each piston is absorbed, at least with regard to its radial component, by the supporting element of this piston.

According to the invention there is provided a device of the type set forth, wherein the said oblique plate is stationary and has a plane surface on which there slide shoes articulated on the pistons by means of said spherical head and seating assemblies, the spherical heads are rigidly connected to the shoes and are each engaged in a matching spherical seating which terminates the outer end of the corresponding piston, and each supporting element extends between two planes perpendicular to the axis of the cylinder barrel and connected to the associated piston, the two planes consisting of a first plane which is spaced from the center of the spherical seating of the associated piston, on the side opposite to the oblique plate, and a second plane which passes through or close to the center of the spherical seating.

Each supporting element preferably consists of a block formed in one piece with its piston and projecting radially towards the outside in relation to this piston, the transverse faces of this supporting element being situated respectively in said two planes.

As a result of the invention, the radial component defined above is transmitted in full to the skirt and consequently does not subject those portions of the pistons which are outside the cylinders to any bending moment, however great may be the inclination of the oblique plate. This enables the pressures which can be achieved in the pump or the motor according to the invention to be increased and, consequently, the specific power and the efficiency of the device to be improved.

BRIEF DESCRIPTION OF THE DRAWINGS

Other features and advantages of the invention will be apparent from the following description and the accompanying drawings which show, by way of non-limiting example, a hydraulic rotary device according to the invention. In the drawings.

DESCRIPTION OF PREFERRED EMBODIMENTS

Figure 1:
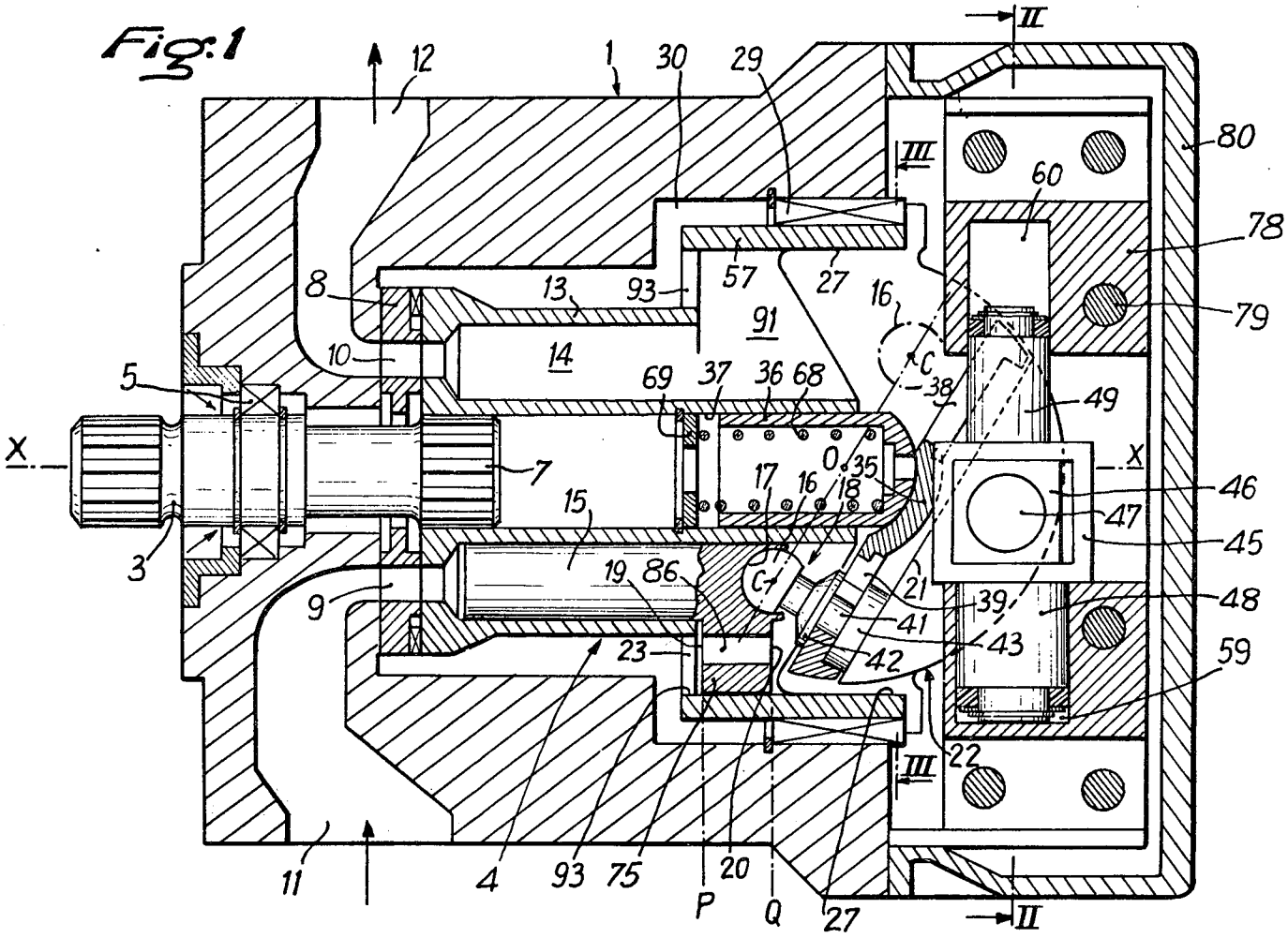
FIG. 1 shows the hydraulic rotary device of the invention, in section on line I—I of FIG. 3, through two axial half-planes which are angularly offset.

The hydraulic rotary device shown in the drawings comprises a stator 1 enclosing a rotor 4 with a cylinder barrel 13 and having an oblique plate 22, on one plane face 21 of which there slide shoes 18 articulated, through spherical heads 16, on the ends of a plurality (for example seven in FIGS. 3 and 4) of cylindrical pistons 15 partially engaged in cylinders 14 which are formed in the cylinder barrel 13 and the geometrical axes of which are regularly distributed over a surface of revolution, the axis of which coincides with the axis X—X of the cylinder barrel 13 or of the rotor 4. Where the oblique plate 22 has a variable inclination about an axis which is perpendicular to the plane of FIG. 1 and the trace of which, in this plane, is designated by reference O, it is preferably formed by a cylindrical sector which is bounded by the plane face 21 and the generatrices of which are parallel to said axis (and therefore perpendicular to the plane of FIG. 1). In FIG. 1, the piston 15 has been removed from the upper cylinder 14 together with the elements associated therewith, to make the drawing clearer; nevertheless, the position of the spherical head 16 associated with this piston is indicated in chain line. The portion of each piston 15 which is adjacent to its spherical head 16 and which is therefore outside the cylinder 14, carries a supporting element 75 which slides axially against the internal face 27 of an external cylindrical skirt 57. This skirt 57 is rigidly connected to the cylinder barrel 13 for rotation therewith and is preferably made integral therewith, and it surrounds all those portions of all the pistons 15 which are outside the cylinders 14. Interposed between the bottom of the stator 1 and the rotary cylinder barrel 13 is a fixed distribution face 8 which, by means of kidney-shaped inlet apertures 9 and outlet apertures 10, connects the bottom of the cylinders 14 successively with inlet passages 11 and outlet passages 12 which pass through the stator 1. The inlet and the outlet respectively constitute the suction and the delivery, in the case of a pump or the admission and the exhaust in the case of a motor. The cylinder barrel 13 is held in contact with the face 8 by means which will be described below. Although the apertures 9 and 10 have been illustrated in FIG. 1, to simplify the drawing, they are, in fact, situated the one above and the other below the plane of this Figure.

At its end opposite to the face 8, the cylinder barrel 13 is mounted floating about a bearing 29 generally consisting of a needle-roller bearing. This bearing is preferably machined spherically to give the piston-chamber freedom about the point O, which lies at the intersection of the axis X—X with the plane of the centers C of the spherical heads 16. This enables the cylinder barrel to have a precise and consequently relatively fluid-tight, bearing against the face 8. The cylinder barrel 13 is connected for rotation, through splines 7, to a shaft 3 which is the drive shaft (of the pump or motor) and which is mounted in the stator 1 by means of a bearing 5. The rotor 4 is centered by the needle roller bearing 29 interposed between the external surface of the skirt 57 and the internal wall of a cavity 30 in the stator 1, where the rotor 4 is housed. This bearing 29 is placed directly at the level of the point O to oppose the radial stresses due to the reaction of the oblique plate 22. The axial position of the cylinder barrel 13 is determined by the fact that it is compelled to remain engaged with the distribution face 8 by the hydraulic pressure and by a spring 68. The shaft 3 is thus held by the bearing 5 and by the splines 7.

As FIG. 1 shows, the spherical heads 16 are rigidly connected to the shoes 18 and are each engaged in a matching spherical seating 17 (see also FIGS. 3 and 5) which terminates the outer end of the corresponding piston 15. Furthermore, each supporting element 75 extends between two planes perpendicular to the axis X—X of the cylinder barrel 13 and connected to the piston 15 concerned, that is to say a first plane P which is spaced apart from the center C of the spherical head 16 of this piston (or from the seating 17) at the side opposite to the oblique plate 22 (that is to say towards the left in FIG. 1), and a second plane Q which passes close to the center C, and indeed lies beyond the center towards oblique plate 22 (that is to say towards the right in FIG. 1). Each supporting element 75 preferably consists of a block made integral with its piston 15 and projecting at least radially outwards in relation to the piston, the transverse faces 19 and 20 of this supporting element or block 75 being situated respectively in the two planes P and Q (see also FIG. 5). The transverse faces 19 and 20 are not necessarily plane but may comprise reliefs and a recess as at 70 (FIG. 5) to facilitate the setting of the spherical heads 16.

Figure 3:
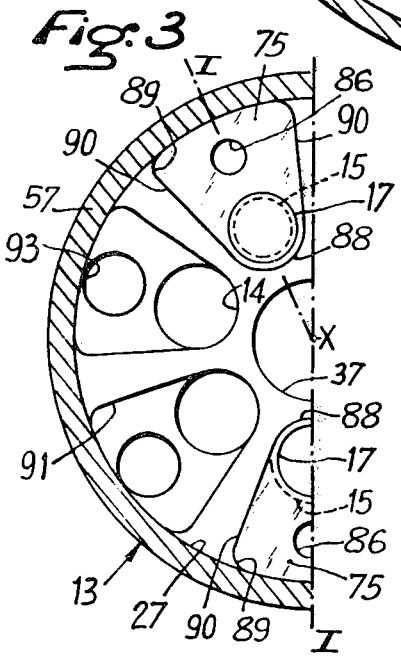
FIG. 3 shows the cylinder barrel of the device, in half cross-section on line III—III FIG. 1, with half a piston of a first type shown at the bottom of the Figure and a piston of a second type shown at the top of the Figure.
Figure 4:
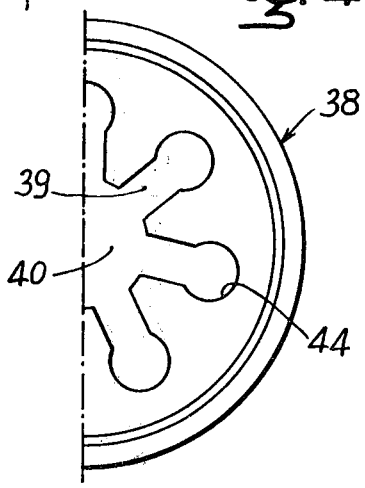
FIG. 4 shows, in plan, half of one of the elements forming the oblique plate of the device of FIG. 1.

As FIG. 3 shows, the blocks 75 are also each bounded by two plane faces 90 (the planes of which pass approximately through the axis X—X), by a portion of convex cylindrical surface 89 on the side of block 75 opposite this axis and by a portion of convex cylindrical surface 88 on the side closer to this axis, the generatrices of these cylindrical surfaces being parallel to the axis X—X. Each block 75 slides in a recess or seating 91 of matching shape which is formed in the cylinder barrel 13 and it is traversed by a bore 86 adapted to ensure a communication of fluid between the two axial end faces 19 and 20 of this block 75. Similarly, the bottom of each recess 91 may be traversed by a hole 93 which prevents any counterpressure from developing in the bottom of the recess.

According to the embodiment illustrated at the bottom of FIG. 3, the convex cylindrical surface 88 bounding the block 75 at the inside is in the extension of the cylindrical surface of the piston 15. Nevertheless, in order to be able to increase the diameter of each spherical head 16 while maintaining its center C on the axis of the piston 15 which is associated therewith, it may be advisable to offset this surface 88 towards the axis X—X, in relation to the geometric extension of the cylindrical surface of the piston, as shown at the top of FIG. 3.

Figure 6:
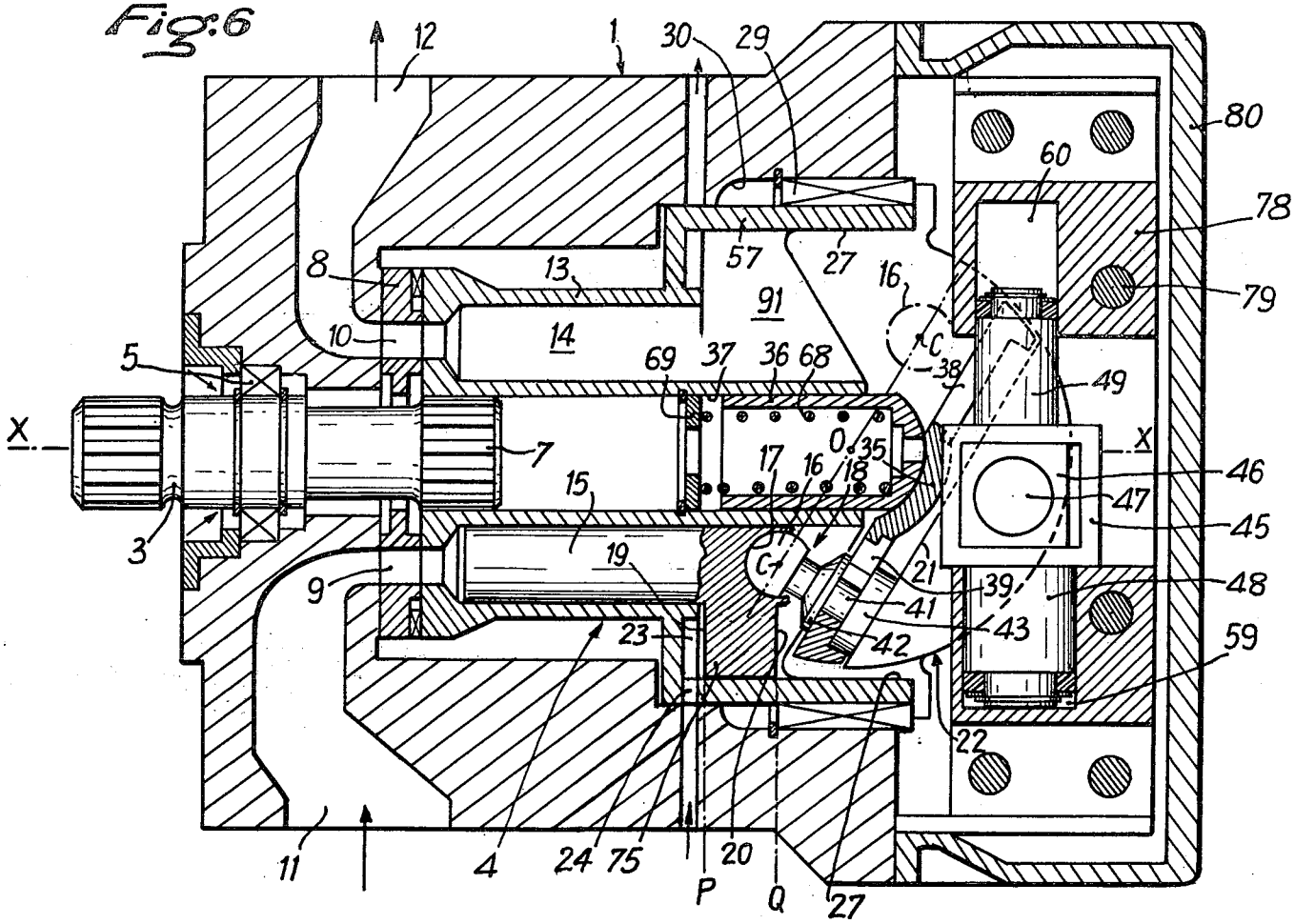
FIG. 6 shows a hydraulic rotary device according to a variation of FIG. 1.

The volume 23 situated between the face 19 of each block 75 and the bottom of the recess 91 follows the same law of variation as the volume of the head of the cylinders 14. It is therefore possible, by eliminating the holes 86 and 93, to construct a true auxiliary pump by providing distribution apertures at the bottom of the recesses 91 and/or as indicated by 24 in FIG. 6 in the cylindrical portion of these recesses. This auxiliary pump has the advantage of being of the variable delivery type with a greater delivery than that of the main pump including pistons 15 and cylinders 14 (in the case where the device according to the invention is a pump). This auxiliary pump generally has a low pressure and can be used as a forcing pump or as a feed pump for the main pump or even as a pump for circulating a fluid serving for the cooling of portions of the main device.

The oblique plate 22 comprises a central dish 35 against which there bears a hollow plunger 36 which slides in an axial bore 37 passing through the cylinder barrel 13. This plunger is held against the dish 35 by the spring 68 which bears against a washer 69 rigidly connected to the cylinder barrel 13. Apart from the central dish 35, the oblique plate 22 is provided with a disc 38 (FIG. 4) having radial slots 39 which lead into a central aperture 40. The spring 68 holds the hollow plunger 36 bearing against the dish 35, itself bearing against the disc 38 which holds the shoes 18 against the oblique plate 22. As for each shoe 18, it has, at the side opposite to the spherical head 16, a cylindrical shank 41 bounded by two shoulders 42 and 43. The diameter of the shanks 41 is equal to the width of the slots 39 and the spacing between the shoulders 42 and 43 is equal to the thickness of the disc 38, measured in the vicinity of these slots. It will be seen that it is thus possible to engage the shoes 18 successively through the central aperture 40 in the disc 38, then to cause them to slide into their respective slots 39 and finally to fix the disc 38 to the dish 35 so that the shoes are held in position with the required play (the slots 39 widening out in a terminal aperture 44) on the oblique plate 22.

The shoes 18 are urged axially by pressure forces, acceleration forces and by some of the force of the spring 68. The pressure causes a preponderant force towards the right of FIG. 1, that is to say towards the oblique plate 22. The calculation of the acceleration forces shows that there is a sector where these forces tend to disengage the shoes 18 from the plate 22. The combination of the two forces of pressure and of acceleration is generally unfavourable to the bearing of each shoe in the quarter of a circle which is situated at the side where the suction of the pump occurs. The disc 38, which is pressed between the two faces of each shoe, bears against the three-quarters of a circle of the shoes which are well urged towards the right in FIG. 1, to maintain the quarter of a circle which would tend to become disengaged. The combination of the support by the spring 68 and possibly by an internal pressure, of the dish 35 and the disc 38 pressed between the two faces of the shoes is novel.

Figure 2:
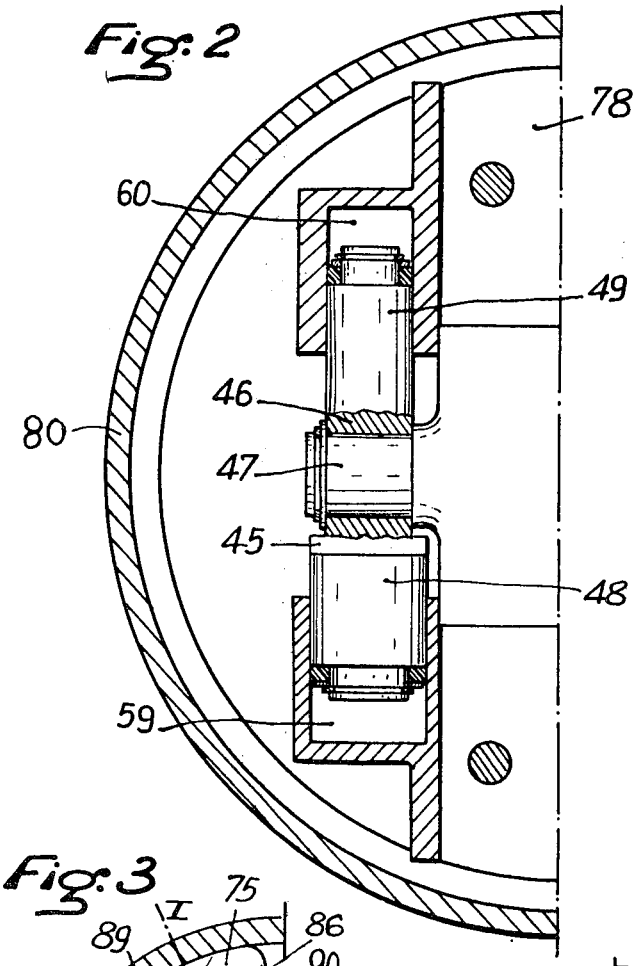
FIG. 2 shows the device of FIG. 1 in a half cross-section on line II—II of FIG. 1.

The oblique plate 22 may have an inclination which is either fixed, or (as shown in FIG. 1) which is adjustable in such a manner as to enable the volume displaced by the pistons 15 on each revolution of the rotor 4 to be modified. In this latter case, the oblique plate 22 may advantageously carry two symmetrical frames 45 (see FIGS. 1 and 2) inside each of which there can slide a block 46 which forms a bearing for a trunnion 47. The two aligned trunnions 47 are rigidly connected to a sliding assembly which consists of two pistons 48, 49 movable in cylinders 59 and 60. These cylinders are formed in a block 78 which is fixed by screws 79 to a cap 80 which is fitted to the stator 1 to block its cavity 30. It will be understood that, by means of a selective feed of the cylinders 59 and 60, it is possible to cause the assembly of the pistons 48, 49, of the trunnions 47 and of the blocks 46 to slide and so to entrain the frames 45 in such a manner as to impart the required inclination to the oblique plate 22.

Figure 5:
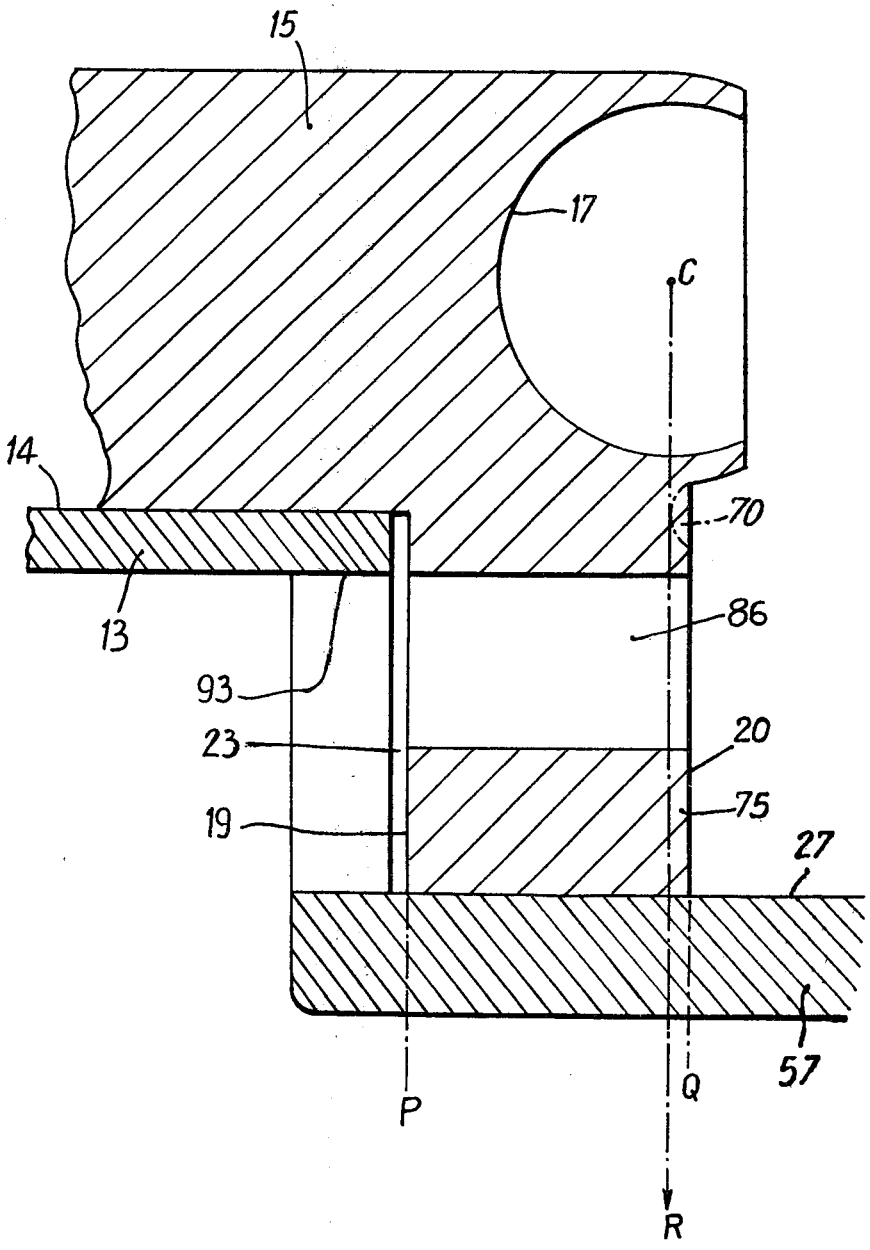
FIG. 5 shows, on a larger scale, a detail of FIG. 1.

Whatever embodiment is adopted, a device is obtained of which the radial component R (see FIG. 5) of the reaction exerted by the oblique plate 22 on the end of each piston 15 is transmitted through the mass of the supporting elements or blocks 75 to the skirt 57, in view of the fact that this reaction passes in the vicinity of the plane Q, and indeed between the planes P and Q, as FIG. 5 shows. This component therefore does not cause any bending moment either on the piston proper 15 or on its supporting element 75, which was the intended aim. In the case where the center C is slightly outside (to the right according to FIG. 1) the plane Q, there is admittedly a residual bending moment but this is very slight in comparison with what it would have been without the supporting element 75; moreover, in view of the thick section of this supporting element, the residual bending moment can be absorbed without risk of breakage.

What has been said on the subject of the radial component R of the reaction applies likewise to its tangential component in view of the fact that each supporting element or block 75 is in contact, over the whole of its cross section, with the internal wall of a recess 91 in the cylinder barrel 13, contrary to the state of the art, as shown by the above cited U.S. Pat. No. 1,427,740.

In the above description, the supporting elements 75 have been described as being bounded by two portions of cylindrical surface 88 and 89 and by two plane faces 90 and as being housed in seatings 91 which are bounded externally by a cylindrical surface which coincides in general with the internal face 27 of the external cylindrical skirt 57. Of course, the invention is not limited to this embodiment and includes the variants according to which the supporting elements 75 and the seatings 91 have shapes different from that which is illustrated, provided that their shapes are matching, that is to say that the supporting elements 75 can slide axially in the seatings 91, being guided by contact with the whole or at least the major portion of the perimeter of these seatings.

I claim:

1. A rotary device with a cylinder barrel which can serve as a pump or as a motor, of the type comprising a stator enclosing a rotor with a cylinder barrel and an oblique plate which acts, by means of spherical head and seating assemblies, on the outer ends of a plurality of cylindrical pistons partially engaged in cylinders which are formed in the cylinder barrel and the geometrical axes of which are regularly distributed over a surface of revolution co-axial with said cylinder barrel, the portion of each piston which is adjacent to the corresponding spherical head and seating assembly being rigidly connected to a rigid supporting element which slides axially against the internal face of an external skirt, which skirt is rigidly connected to the cylinder barrel for rotation therewith and surrounds all those portions of all of the pistons which are outside the cylinders, wherein:

the said oblique plate is stationary and has a plane surface on which there slide shoes articulated on the piston by means of said spherical head and seating assemblies;

the spherical heads are rigidly connected to the said shoes and are each engaged in a matching spherical seating which terminates the outer end of the corresponding piston;

each supporting element extends between two planes perpendicular to the axis of the cylinder barrel and connected to the associated piston, each supporting element contacts said internal face of said external skirt between said two planes, the two planes consisting of a first plane which is spaced from the center of the spherical seating of the associated piston on the side opposite to the oblique plate, and a second plane which passes at least proximately to the center of the spherical seating, each supporting element forming part of a block bounded by two plane faces, by a portion of cylindrical surface on the side of the block opposite to the axis of the cylinder barrel and by another portion of a cylindrical surface on the side of the block closer to this axis, the block sliding in a recess of complementary shape formed in the cylinder barrel.

2. A rotary device as claimed in claim 1, wherein each block is traversed by a bore effecting a communication of fluid between the two axial end faces of the block.

3. A rotary device with a cylinder barrel which can serve as a pump or as a motor, of the type comprising a stator enclosing a rotor with a cylinder barrel and an oblique plate which acts, by means of spherical head and seating assemblies, on the outer ends of a plurality of cylindrical pistons partially engaged in cylinders which are formed in the cylinder barrel and the geometrical axes of which are regularly distributed over a surface of revolution coaxial with said cylinder barrel, the portion of each piston which is adjacent to the corresponding spherical head and seating assembly being rigidly connected to a rigid supporting element which slides axially against the internal face of an external skirt, which skirt is rigidly connected to the cylinder barrel for rotation therewith and surrounds all those portions of all the pistons which are outside the cylinders, wherein:

the said oblique plate is stationary and has a plane surface on which there slide shoes articulated on the pistons by means of said spherical head and seating assemblies;

the spherical heads are rigidly connected to the said shoes and are each engaged in a matching spherical seating which terminates the outer end of the corresponding piston, and each supporting element extends between two planes perpendicular to the axis of the cylinder barrel and connected to the associated piston, each supporting element contacts said internal face of said external skirt between said two planes, the two planes consisting of a first plane which is spaced from the center of the spherical seating of the associated piston, on the side opposite to the oblique plate, and a second plane which passes at least proximately to the center of the spherical seating, said cylinder barrel has a plurality of recesses, one for each said supporting element and each shaped complementarily thereto, a said supporting element being slidable in a said recess in said cylinder barrel.

4. A rotary device with a cylinder barrel which can serve as a pump or as a motor, of the type comprising a stator enclosing a rotor with a cylinder barrel and an oblique plate which acts, by means of spherical head and seating assemblies, on the outer ends of a plurality of cylindrical pistons partially engaged in cylinders which are formed in the cylinder barrel and the geometrical axes of which are regularly distributed over a surface of revolution co-axial with said cylinder barrel, the portion of each piston which is adjacent to the corresponding spherical head and seating assembly being rigidly connected to a rigid supporting element which slides axially against the internal face of an external skirt, which skirt is rigidly connected to the cylinder barrel for rotation therewith and surrounds all those portions of all of the pistons which are outside the cylinders, wherein:

the said oblique plate is stationary and has a plane surface on which there slide shoes articulated on the piston by means of said spherical head and seating assemblies;

the spherical heads are rigidly connected to the said shoes and are each engaged in a matching spherical seating which terminates the outer end of the corresponding piston, each supporting element extends between two planes perpendicular to the axis of the cylinder barrel and connected to the associated piston, each supporting element contacts said internal face of said external skirt between said two planes, the two planes consisting of a first plane which is spaced from the center of the spherical seating of the associated piston, on the side opposite to the oblique plate, and a second plane which passes at least proximately to the center of the spherical seating, said cylinder barrel has a plurality of recesses, one for each said supporting element and each shaped complementarily thereto, a said supporting element being slidable in a said recess in said cylinder barrel, each supporting element comprising a block made integral with the associated piston and projecting radially outwardly relative to the piston, the axial end faces of the supporting element being situated respectively in said two planes.

5. A rotary device with a cylinder barrel which can serve as a pump or as a motor, of the type comprising a stator enclosing a rotor with a cylinder barrel and an oblique plate which acts, by means of spherical head and seating assemblies, on the outer ends of a plurality of cylindrical pistons partially engaged in cylinders which are formed in the cylinder barrel and the geometrical axes of which are regularly distributed over a surface of revolution co-axial with said cylinder barrel, the portion of each piston which is adjacent to the corresponding spherical head and seating assembly being rigidly connected to a rigid supporting element which slides axially against the internal face of an external skirt, which skirt is rigidly connected to the cylinder barrel for rotation therewith and surrounds all those portions of all of the pistons which are outside the cylinders, wherein:

the said oblique plate is stationary and has a plane surface on which there slide shoes articulated on the piston by means of said spherical head and seating assemblies;

the spherical heads are rigidly connected to the said shoes and are each engaged in a matching spherical seating which terminates the outer end of the corresponding piston, each supporting element extends between two planes perpendicular to the axis of the cylinder barrel and connected to the associated piston, each supporting element contacts said internal face of said external skirt between said two planes, the two planes consisting of a first plane which is spaced from the center of the spherical seating of the associated piston, on the side opposite to the oblique plate, and a second plane which passes at least proximately to the center of the spherical seating, said cylinder barrel has a plurality of recesses, one for each said supporting element and shaped complementarily thereto, a said supporting element being slidable in a said recess in said cylinder barrel, said supporting elements of the pistons forming, with the recesses in the cylinder barrel in which they are guided, an auxiliary pump.

* * * * *